US005169360A

United States Patent [19]

Saunders

[11] Patent Number: 5,169,360

[45] Date of Patent: Dec. 8, 1992

[54] AEROBIC STEP DEVICE

[75] Inventor: William J. Saunders, Lithonia, Ga.

[73] Assignee: Sports Step, Inc., Marietta, Ga.

[21] Appl. No.: 598,099

[22] Filed: Oct. 16, 1990

[51] Int. Cl.[5] ..... A63B 5/00

[52] U.S. Cl. ..... 482/52; 482/908; 248/188.2; 108/12; 297/439

[58] Field of Search ..... 297/439, 461, 462; 248/188.2; 108/11, 12, 18, 19, 144, 146, 157, 159, 54.1; 482/52, 142, 908

[56] References Cited

U.S. PATENT DOCUMENTS

| | | | |
|---|---|---|---|
| 3,179,071 | 4/1965 | Johnston | 108/144 |
| 3,653,915 | 4/1972 | Drabert et al. | 108/144 |
| 4,516,508 | 5/1985 | Kako et al. | 248/188.2 |

FOREIGN PATENT DOCUMENTS

| | | | |
|---|---|---|---|
| 104517 | 5/1924 | Switzerland | 108/141 |
| 26102 | of 1906 | United Kingdom | 108/144 |

*Primary Examiner*—Gene Mancene
*Assistant Examiner*—L. Thomas
*Attorney, Agent, or Firm*—Needle & Rosenberg

[57] ABSTRACT

An aerobic step device comprising a platform and a detachable leg assemblies for maintaining the platform at selected heights above a support surface. The platform has a skirt depending from the edges of a top, flat rectangular surface. Each leg assembly includes a pair of laterally extending arms, each of which have a protrusion which engages a selected one of at least a pair of slots that are provided on the inner surface of opposed sides of the skirt, the slots being longitudinally and vertically offset from each other. The height of the platform depends into which slot the protrusion is received into. Ribs and locking tabs depend from the underside of the top surface of the platform to engage respective channels and openings in the leg assemblies in order to stabilize the device in its operative positions.

12 Claims, 2 Drawing Sheets

AEROBIC STEP DEVICE

BACKGROUND OF THE INVENTION

The present invention relates to aerobic exercise devices and, more particularly, to a stepping structure that is adjustable in height for aerobic exercises.

It is known in aerobic exercising to use a conditioning program based on stair climbing to simultaneously develop strength and improved cardiovascular endurance. For instance, during a 60-minute aerobic workout, the participant may, using optional hand-held weights, climb on and off platforms that are available at a number of different heights. Such stepping sessions may last from five to twenty-five minutes per period during such workouts and are combined with traditional aerobic movements.

The disadvantage of the present stair climbing programs is that they utilize fixed-height platforms which do not easily accommodate participants of varying degrees of physical height or expertise in aerobics. Also, the fixed platforms or steps make it more difficult to vary the intensity of the exercise. In group classes, the participant may be forced to use a step at a particular height based only upon availability and not upon proper sizing. This can make a workout either too hard or too easy. Also, in the home market, the fixed-height platform does not allow for interval training or improved conditioning of the participant.

Present stair climbing devices which have an adjustable height feature are not compact since the height-adjustment is usually carried out by a plurality of nettable supports which have to be stored when not required to be used. A compact aerobic step device is desired.

SUMMARY OF THE INVENTION

The above disadvantages of the prior art are overcome by the present invention which comprises an exercise platform that is supported at various heights above a support surface by adjustable leg assemblies. Each leg assembly has protrusions which engage selected slots provided longitudinally and vertically offset from each other on the opposed walls of a skirt which depends from the exercise platform.

Specifically, the device comprises a rectangular, horizontal top surface upon which the person steps. Opposed side and end walls depend from the top surface. Means for detachably securing a pair of leg assemblies to the device are provided on the inner surfaces of the side walls and comprise a pair of height adjustment assemblies. Each of the height adjustment assemblies includes a pair of longitudinally and vertically offset first and second slots. The complementary pair of slots on the opposed walls each engage a protrusion on the distal end of a pair of arms that project laterally from each leg assembly. The first slot with the protrusion therein maintains the platform at a first height and the second slot with the protrusion therein maintains the platform at a second height.

Since the slots are offset from each other, the overall profile or length of the device varies, depending on which slot is engaged by the protrusion.

Various means are provided to stabilize the leg assemblies at their respective positions and include ribs which longitudinally depend from the underside of the top surface to engage laterally extending channels in the leg assemblies to a depth that depends upon which slot is engaged by the protrusion. Also, flexible locking tabs project downwardly from the underside of the top surface to engage a selected opening in the leg assembly.

DETAILED DESCRIPTION OF THE ILLUSTRATIVE EMBODIMENT

Figure 1:
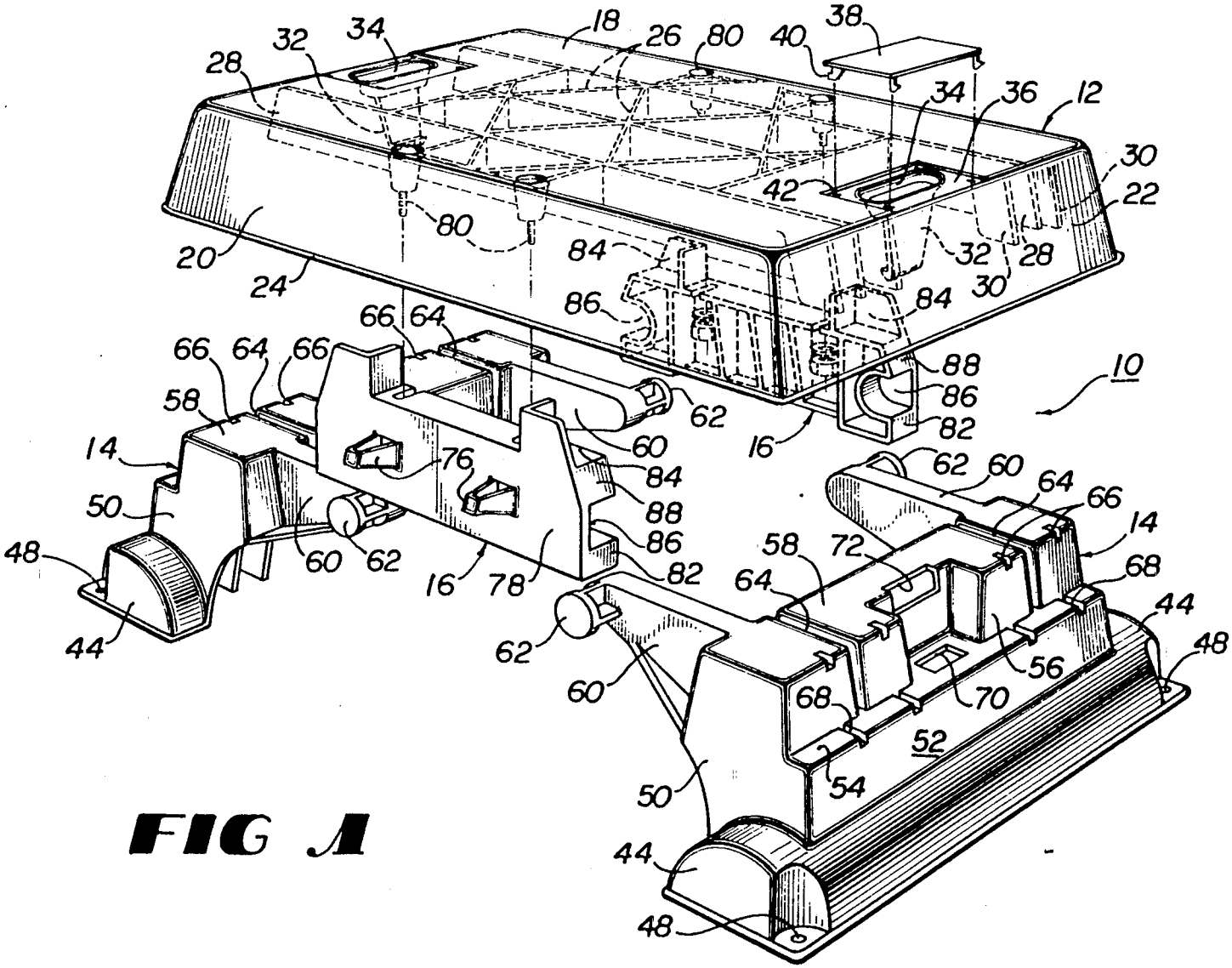
FIG. 1 is an exploded perspective view of the present invention.

Referring to FIG. 1, the numeral 10 denotes generally the aerobic step device of the present invention which comprises a platform 12, leg assemblies 14 and assemblies 16 for detachably securing the leg assemblies 14 to the platform 12. All of the elements of the device 10 can be constructed of an appropriate plastic material.

The platform 12 is generally rectangular in shape and has a flat upper surface 18 that has opposed side and end walls 20, 22 depending outwardly from the respective edges of upper surface 18 and which terminate in bottom edge 24.

Figure 2:
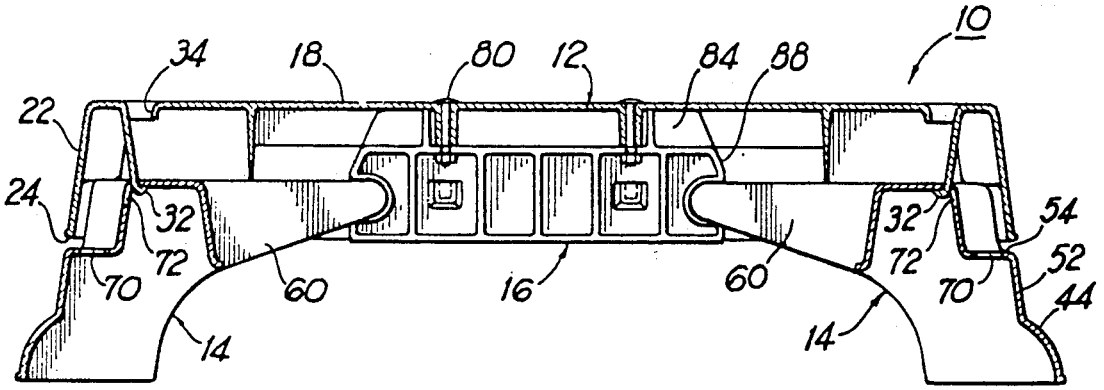
FIG. 2 is a front, vertical cross-sectional view of the present invention at a first height.
Figure 3:
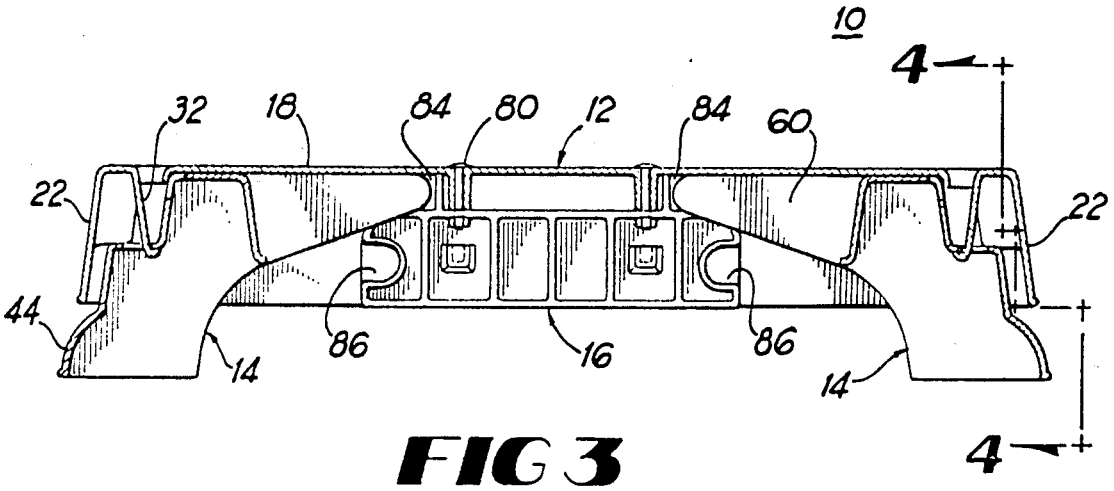
FIG. 3 is a front, vertical cross-sectional view of the present invention at a second height.
Figure 4:
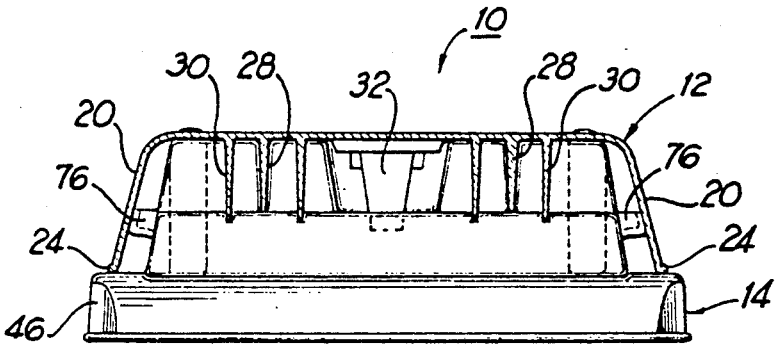
FIG. 4 is an end view taken along line 4—4 in FIG. 3.

As seen in FIGS. 2–4, the walls 20, 22 provide a flaring skirt for the platform 12. The underside of upper surface 18 is provided with a repetitive honey-comb pattern 26 for structural reinforcement purposes.

A pair of ribs 28 longitudinally depend from the underside of upper surface 18. As seen in FIG. 4, a pair of teeth 30 project downwardly from the underside of upper surface 18 adjacent each of the end walls 22 on either side of each of the ribs 28.

As seen in FIGS. 1 and 4, a pair of flexible locking tabs 32 project downwardly from the center of underside of upper surface 18 adjacent each end wall 22. The tabs 32 may be spring biased. The tabs 32, along with ribs 28 and teeth 30, engage the leg assemblies 14, as described below. The tabs 32 are manually disengaged from the leg assemblies 14 through access slots 34 provided through surface 18 and which are located within respective recesses 36 that are normally covered by plates 38. The plates 38 are snap-fitted within recesses 36 by means of depending cleats 40 that engage cleat holes 42.

The leg assemblies 14 are of unitary construction as, as seen in FIGS. 2 and 3, and have a stepped profile, including a bulbous bottom portion 44, which rests on a support surface (not shown), such as a floor. Indentations 46 are provided on the outer edges of the bottom portion 44 to provide access to holes 48 which may be used to secure by screws (not shown) the leg assemblies 14 to the support surface.

The main body portion 50 extends upwardly from bottom portion 44 and includes a first section having an upright wall 52 that terminates in first horizontal level 54. Level 54 terminates in the vertical face 56 of the second section which terminates in flat second level 58. A pair of arms 60 extend outwardly from the rear of the assemblies 14 and have laterally projecting, outwardly directed protrusions 62 on each of the distal ends of arms 60.

A pair of channels 64 laterally extend through the second level 58 to the first level 54 and are complimentarily located to receive therein the respective rib 28.

Also provided on each of the leg assemblies 14 are recesses 66 in the second level 58 on either side of the channels 64 and slots 68 in the first level 54, each of which engage a tooth 30, as described below. The leg assemblies further include a first opening 70 centrally disposed through the first level 54 and a second opening 72 aligned with the first opening 70 and being provided within an inset 74 in the face 56.

The pair of securing assemblies 16 are identical in construction, are substantially rectangular in shape and include stabilizing projections 76 which extend from the rear wall 78 to engage the inner surface of the flaring side walls 20, as seen in FIG. 4. The securing assemblies 16 are maintained in position against the interior surfaces of the side walls 20 by any suitable securing means, including screws 80 through upper surface 18. The assemblies 16 could also be integrally molded into the side walls 20.

The opposed side edges 82 of the assemblies 16 are provided with longitudinally extending first and second slots, 84, 86 which are separated by sloping shoulder 88. The slots 84, 86 are dimensioned to receive therein a protrusion 62 and are longitudinally and vertically offset from one another, so that the platform 12 is maintained at a selected height, depending upon which slot 84, 86 receives protrusion 62.

Three different height levels can be obtained with the embodiment as shown in the figures of the drawings. If the platform 12 is utilized by itself (i.e., without the leg assemblies 14), then the upper surface 18 is approximately 4 inches above the supporting surface. As seen in FIG. 3 with the protrusion 62 engaging the upper or first slot 84, the upper surface 18 is approximately 6 inches from the supporting surface. With the protrusion 62 in the lower or second slot 86, as shown in FIG. 2, the device is at its full height or approximately 8 inches above the supporting surface.

Alternative embodiment of the device 10 can have the leg assemblies 14 configured to give the device, 10 any desired height. Also, the location of the slots 84, 86 and the protrusions 62 are a matter of choice.

OPERATION

If the device 10 is desired to be utilized at its maximum height as shown in FIG. 2, the user slides the protrusion 62 of each of the arms 60 of each of the leg assemblies 14 into a respective second slot 86. The assembly is then pivoted upwardly until the locking tab 32 engages the opening 72. In that manner, the teeth 30 will engage the recesses 66 and the ribs 28 will just enter the channels 64.

If the user then wishes to lower the height of the device 10, the plates 38 are removed to expose the access slots 34 and the tabs 32. The user inserts a finger through the slot 34 and pushes the respective tab 32 toward the inner wall 22, thereby disengaging the tab 32 from the opening 72. -The leg assembly 14 is then pulled downwardly so as to disengage protrusion 62 from slot 84. The protrusion 62 rides upon sloping shoulder 88 until it is then received within the slot 86. The leg assembly is then pivoted upwardly about the protrusions 62 until the locking tabs 32 engage opening 70.

As shown in FIGS. 2 and 3, a feature of the device is that with the device 10 at its greatest height (FIG. 2), the device 10 has its longest profile to import greater stability. However, as the leg assemblies 14 are moved from the lower slot 86 to the upper slot 84 to assume the lower height of FIG. 1, the profile of the device 10 decreases since the slots 84, 86 are vertically offset from each other.

What is claimed is:

1. An aerobic step device, comprising:

(a) a platform;

(b) a pair of leg assemblies for maintaining the platform at selected heights parallel to and above a support surface and providing the user with a stable platform capable of being repeatedly stood upon at each height; and (c) means for detachably securing the leg assemblies to the platform comprising a protrusion and a slot for mating engagement with the protrusion and further comprising, for each of the selected heights, a surface on each of the leg assemblies which engages a corresponding surface on the platform.

2. A device as claimed in claim 1, wherein the platform comprises a flat top surface, a pair of side walls depending from the opposed side edges of the top surface and a pair of end walls depending from the opposed end edges of the top surface wherein the protrusion is on the leg assembly and the slot is on the platform and wherein the bottom surfaces of the side edges and the side walls are in a common plane which is parallel to the top surface.

3. A device as claimed in claim 2 wherein he securing means comprises a pair of first slots and a pair of second slots, the first slots being longitudinally and vertically offset form the second slots, with the distance from the support surface to each of the first slots being a first height and the distance from the support surface to each of the second slots being a second height, whereby the platform is at a selected first or second height when the protrusion engages a selected first or second slot.

4. A device as claimed in claim 3, wherein the leg assemblies have a bottom portion which rests on the support surface, a main body portion extending upwardly from the bottom and a pair of arms extending laterally outwardly from the body portion, the protrusion being located on the digital ends of each of the arms.

5. A device as claimed in claim 4, wherein the platform further comprises a pair of opposed ribs longitudinally depending from the underside of the top surface and wherein the body portion of each leg assembly includes a pair of opposed, longitudinally extending channel members thereon which receive therein the ribs at first and second depths according to the respective position of the protrusion being received in a first or second slot.

6. A device as claimed in claim 5, wherein the body portion of each leg assembly includes a stepped profile forming a first lower level and a second upper level, wherein aligned recesses are formed in the body portion at the first and second levels and wherein the platform further comprises laterally aligned teeth members depending from the underside of the top surface adjacent the end walls, each of the teeth members being received within a complimentary recess according to the respective position of the protrusion being received in the first or second slot.

7. A device as claimed in claim 6, wherein the channel members are located on the second upper level of the body portion of each leg assembly.

8. A device as claimed in claim 6 and further comprising a locking tab projecting downwardly from the underside of the top surface adjacent each of the end walls and a first opening being defined through the first level and a second opening being defined through the second level and being in alignment with the first opening, the tab being received in a selected first or second opening according to the respective position of the protrusion being received in a first or second slot.

9. A device as claimed in claim 3, wherein the slots are horizontally disposed.

10. An aerobic step device, comprising:

(a) A platform comprising a flat top surface, a pair of side walls depending from the opposed side edges of the top surface and a pair of end walls depending from the opposed end edges of the top surface, the bottom of the side walls and side edges being in a plane which is parallel to the top surface;

(b) a leg assembly for maintaining the platform at selected heights above a support surface; and (c) means for detachably securing the leg assembly to the platform comprising a first slot and a second slot on each of the interior surfaces of the side walls and which are longitudinally and vertically offset from each other and a pair of protrusions on the leg assembly for respective engagement with the slots, whereby the platform is at a selected first or second height when the protrusions engage selected first slots or second slots.

11. A device as claimed in claim 1 wherein said leg assemblies are horizontally slidable.

12. An aerobic step device, comprising:

(a) a platform;

(b) a pair of leg assemblies for maintaining the platform at selected heights parallel to and above a support surface and providing the user with a stable platform capable of being repeatedly stood upon at each height; and (c) means for detachably securing the leg assemblies to the platform comprising a protrusion and a slot for mating engagement with the protrusion wherein the platform comprises a flat top surface, a pair of side walls depending from the opposed side edges of the top surface and a pair of end walls depending from the opposed end edges of the top surface wherein the protrusion is on the leg assembly and the slot is on the platform and wherein the bottom surfaces of the side edges and the side walls are in a common plane which is parallel to the top surface.

* * * * *